United States Patent [19]

Ueki et al.

[11] 4,139,810

[45] Feb. 13, 1979

[54] DEVICE FOR STOPPING PASSENGER CONVEYOR

[75] Inventors: Yasuo Ueki; Masaaki Nakayama, both of Inazawa, Japan

[73] Assignee: Mitsubishi Denki Kabushiki Kaisha, Tokyo, Japan

[21] Appl. No.: 780,349

[22] Filed: Mar. 23, 1977

[30] Foreign Application Priority Data

Apr. 2, 1976 [JP] Japan ..... 51-36743

[51] Int. Cl.[2] ..... H01H 47/04

[52] U.S. Cl. ..... 318/372; 318/270; 318/364

[58] Field of Search ..... 318/364, 380, 270, 487, 318/371, 325, 420–422, 462, 365, 369, 372

[56] References Cited

U.S. PATENT DOCUMENTS

| | | | |
|---|---|---|---|
| 2,666,176 | 1/1954 | Fath | 318/371 |
| 2,712,365 | 7/1955 | Burns | 318/372 |
| 3,130,358 | 4/1964 | Lang | 318/371 |
| 3,794,897 | 2/1974 | Bradley | 318/270 |
| 3,902,635 | 9/1959 | Kuka | 318/380 |

*Primary Examiner*—David Smith, Jr.

*Attorney, Agent, or Firm*—Wenderoth, Lind & Ponack

[57] ABSTRACT

The present invention is a device for stopping a passenger conveyor.

A stop pushbutton is depressed to deenergize a driving motor for an escalator and an operating winding for an electromagnetic brake. The electromagnetic brake has a mechanical braking means whose operations is opposed by the magnetic force of the operating winding. Then two timing relays are energized and also the brake operating winding is reenergized through a variable resistor to brake the motor with a low braking force. The timing relays are successively picked up after predetermined time intervals to increase the resistance of the resistor to increase the braking force stepwise by decreasing the current and hence the magnetic force of the operating winding. When the escalator reaches a predetermined low speed, the brake operating winding is again deenergized to apply the rated braking force to the motor until the escalator is stopped.

5 Claims, 4 Drawing Figures

DEVICE FOR STOPPING PASSENGER CONVEYOR

BACKGROUND OF THE INVENTION

This invention relates to improvements in a devide for stopping a passenger conveyor such as an escalator or the like.

The stopping of passenger conveyors includes two types, one of which is an emergency stop and the other of which is a normal stop. The emergency stoppage of passenger conveyors is an urgent stop in response to the actuation of a particular safety device or to the depression of an emergency stop pushbutton signaling the occurrence of an emergency. On the other hand, the normal stoppage of passenger conveyors is a stop in the normal manner which is not urgently required for passengers thereon. For example, a passenger conveyor can be stopped by depressing a stop pushbotton for the purpose of changing its traveling speed or reversing its direction of travel. In this cases it is stopped with full knowledge that the passengers ride on the conveyor to increase its load. Alternatively the passenger conveyor can be stopped in response to the energization of an overcurrent relay.

Upon stopping any passenger conveyor, it has been previously a comman practice to disconnect the particular electric motor driving the conveyor from the associated electric source while at the same time deenergizing a mating electromagnet of an electromagnetic brake to brake the electric motor regardless of whether an emergency stop or a normal stop is effected. The braking force exerted by that electromagnetic brake has been usually set to stop the passenger conveyor with such a deceleration that, during an emergency stop it is stopped as quickly as possible, that is to say, passengers riding, for example, on an escalator do not fall down during the "DOWN" travel under the full load which required the longest braking distance. Under other circumstances such as if the electromagnetic brake is applied to the escalator during the "DOWN" travel under a light load or during the "UP" travel in which a load due to the passengers is applied to the escalator, as an additional braking force, then there is a fear that the passengers may fall down due to the deceleration.

Accordingly, it is an object of the present invention to eliminate the disadvantage of the prior art practice as described above by the provision of a passenger conveyor-stopping device capable of safely and reliably stopping the passenger conveyor without an injury such as a violent fall inflicted on any of passengers riding thereon only upon the normal stoppage thereof.

SUMMARY OF THE INVENTION

The present invention provides a device for stopping a passenger conveyor comprising an electromagnetic brake means including an operating winding and an electric motor for driving the passenger conveyor. The electromagnetic brake means is responsive to the energization of the operating winding to release its braking operation and responsive to the deenergization of the operating winding to brake the electric motor with a predetermined braking force. The stopping device comprises a set of braking sensor contacts responsive to the braking operation of the electromagnetic brake means, a set of stall sensor contacts operative at a predetermined low speed of the passenger conveyor, a resistor means serially connected to the operating winding to partly release the electromagnetic brake means, and means for again energizing the operating winding through the resistor means immediately after the operation of the set of braking sensor contacts and deenergizing the operating winding after the set of stall sensor contacts has been operated.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
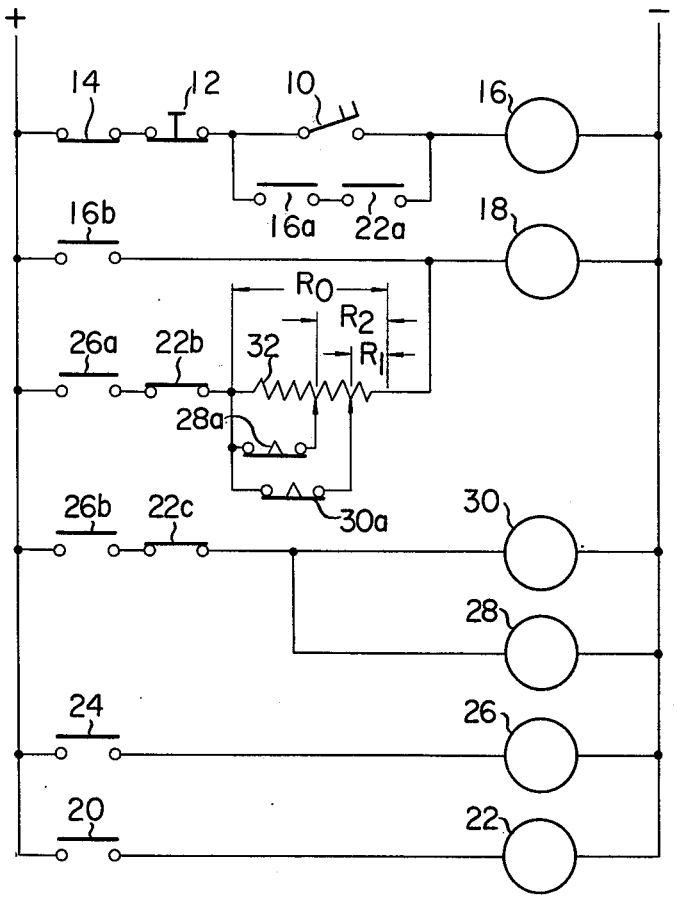
FIG. 1 is a schematic circuit diagram of a device for stopping a passenger conveyor constructed in accordance with the principles of the present invention.

Referring now to FIG. 1 of the drawings, there is illustrated a combined "UP" travel and normal stoppage section of an escalator control circuit embodying the principles of the present invention. The arrangement illustrated comprises an "UP" travel starting switch 10 having one side connected to the positive side of a source of direct current through a normally closed stop pushbutton 12 and a set of normally closed contacts 14 serially interconnected and at the other side connected to the negative side of the source through an "UP" travel electromagnetic contactor 16. The positive side of the source is represented by a vertical line labelled with a plus symbol (+) and the negative side thereof is represented by another vertical line labelled with the minus symbol (−). The contact set 14 is adapted to be controlled by an overcurrent relay (not shown).

The electromagnetic contactor 16 includes a set of normally open contacts **16*a* connected to the junction of the stop pushbutton 12 and the start switch 10 and another set of normally open contacts 16*b* connected at one end to the positive side of the source and at the other end to the negative side of the source through an operating winding 18 of an electromagnetic brake. The electromagnetic brake is responsive to the deenergization of its operating winding 18 to brake the electric motor for the associated escalator through a mating spring and is responsive to the energization of the operating winding 18** to release the braking of the motor by means of the action of an associated electromagnet against the action of the spring. The electromagnetic brake itself, the spring, the electromagnet and the electric motor are not illustrated.

As shown in FIG. 1, a contact set 20 controlled by a brake switch (not shown) is serially connected to an operating winding 22 of a status-of-contact sensor relay between the positive and negative sides of the source. The brake switch interlocks with a movable iron core included in the electromagnet of the electromagnetic brake to open the contact set 20 during the braking and to close it upon release of the braking. Thus the status-of-contact sensor relay represented by the operating winding 22 is operative to sense the status of the contact set 20. Similarly another contact set 24 is serially connected to an operating coil 26 of another status-of-contact sensor relay across the DC source. The contact set 24 is controlled by a governor (not shown) to be opened when the speed of the associated escalator reaches a predetermined magnitude, for example, 20% of its rated speed or less. Therefore the status-of-contact sensor relay represented by the operating winding 26 is operative to sense the status of the contact set 24.

Further a parallel combination of two timing relays represented by the operating windings 28 and 30, respectively, is serially connected to a series combination of a normally closed contact set 22*c* of the relay 22 and a normally open contact set 26*b* of the relay 26 between the positive and negative sides of the source. When energized, the timing relays 28 and 30 are picked up after restrictive different predetermined time intervals and dropped out immediately after their deenergization. For example, the timing relay 28 is picked up one second after its energization while the timing relay 30 is picked up two seconds after its energization.

The operating brake winding 18 is also connected to a current limiting resistor 32 subsequently connected to the positive side of the source through a normally closed contact set 22*b* of the status-of-contact sensor relay 22 and a normally open contact set 26*a* of the status-of-contact sensor relay 26 serially interconnected. The resistor 32 is shown in FIG. 1 as including a pair of taps thereon connected to the junction of the resistor 32 and the normally closed contact set 22*b* through normally closed contact sets 28*a* and 30*a* respectively. The contact sets 28*a* and 30*a* are controlled by the timing relays 28 and 30 respectively.

The starting switch 10 is also connected across a series combination of normally open contact sets 16*a* and 22*a* controlled by the contactor 16 and the status-of-contact sensor relay 22 respectively.

The closure of the "UP" travel stating switch 10 causes the electromagnetic contactor 16 to be energized from the DC source through a current path traced from the positive side of the source through the normally closed contact set 14 of the overcurrent relay, the normally closed stop pushbutton 12, the now closed switch 10, the contactor 16 and thence to the negative side of the source to energize the contactor 16 thereby to close its contact sets 16*a* and 16*b*. The closure of the contact set 16*a* does not immediately affect the system but the closure of the contact set 16*b* permits the brake winding 18 to be energized. This releases the electromagnetic brake from braking the associated electric motor (not shown) for driving the escalator (not shown) while at the same time closing another contact set (not shown) of the electromagnetic contactor 16 to connect the electric motor of the escalator to a source of electric power (not shown). As a result, the escalator is driven in its ascending direction.

On the other hand, the contact set 20 of the brake switch is closed by the release of the electromagnetic brake from its braking. This closure of the contact set 20 permits the energization of the status-of-contact sensor relay 22 which closes the contact set 22*a* and which opens the contact sets 22*b* and 22*c*. The closure of contact set 22*a* forms a current path traced from the positive side of the source through the contact set 14, the pushbutton 12, the closed contact set 16*a*, the now closed contact set 22*a*, the contactor 16 and thence to the negative side of the source. Thus the contactor 16 is self-held by the current path just described.

Under these circumstances, the speed of the escalator exceeds the predetermined magnitude whereupon the governor contact set 24 is closed. Thus the status-of-contact sensor relay 26 is energized to close its contact sets 26*a* and 26*b*. However, the closure of the contact sets 26*a* and 26*b* does not result in the flow of current through the timing relays 28 or 30 and the resistor 32. This is because the contact sets 22*b* and 22*c* are maintained in their open position.

During this "UP" travel it is assumed that the stop pushbutton 12 is depressed, or alternatively, the overcurrent relay (not shown) is energized, opening its contact set 14. The operation of the system following the opening of the pushbutton 12 or the contact set 14 will now be described with reference to FIGS. 2 and 3.

Figure 2:
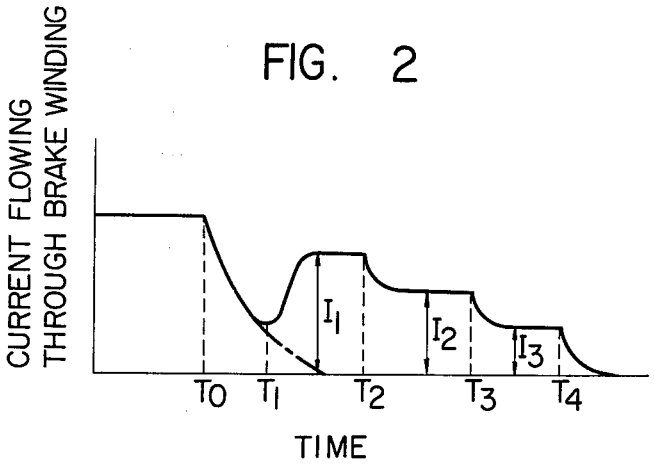
FIG. 2 is a graph illustrating the current flowing through the operating brake winding shown in FIG. 1 as a function of time.
Figure 3:
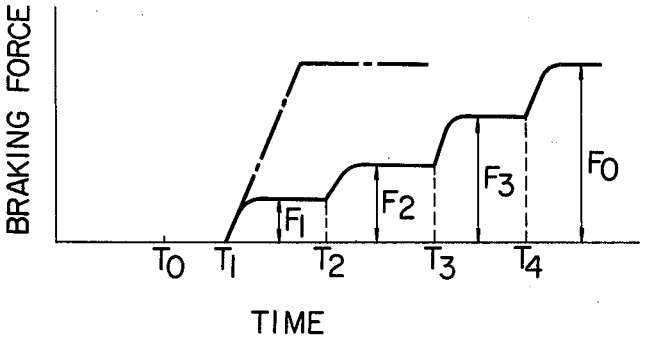
FIG. 3 is a graph illustrating the braking force exerted by an electromagnetic brake as a function of time.

FIG. 2 shows as the ordinate, the current flowing through the brake winding 18 and FIG. 3 shows as the ordinate, the braking force applied by the brake with the time axis in FIG. 2 identical to that in FIG. 3.

When the stop pushbutton 12 or the overcurrent contact set 14 is opened at time point $T_o$ (see FIGS. 2 and 3), the electromagnetic contactor 16 is deenergized to open its contact sets 16*a* and 16*b*. Also another contact set (not shown) of the contactor 16 is opened to disconnect the electric motor of the escalator from the associated power source. At the same time, the opening of the contact set 16*b* causes the deenergization of the brake winding 18. At time point $T_1$ (see FIGS. 2 and 3) after the lapse of a short time interval, the movable iron core of the electromagnet disposed in the electromagnetic brake is operated to initiate braking the electric motor. Substantially simultaneously the contact set 20 is opened to permit the deenergization of the status-of-contact sensor relay 22. This opens the contact set 22*a* and closes the contact sets 22*b* and 22*c*. The closure of the contact set 22*c* does not lead to the immediate pickup of the timing relays 28 and 30 due to the delay associated with these relays. The closure of the contact set 22*b* completes a current path traced from the positive side of the source through the contact set 26*a*, the contact set 22*b*, that portion of the resistor 32 labelled $R_1$ in FIG. 1, the brake winding 18 and thence to the negative side of the source. This reenergizes the brake winding 18 until a current $I_1$ flows through the brake winding 18 (see FIG. 2). This braking current is less than the current which flowed through the winding before the opening of the pushbutton 12 or the contact set 14 and serves to decrease the braking force due to a spring force involved with the result that the motor is braked with a relatively low braking force $F_1$ (see FIG. 3). When a predetermined time interval elapses after the energization of the relay 22, that is to say, when time point $T_2$ (see FIGS. 2 and 3) is reached, the timing relay 30 is picked up to open its contact set 30*a*. This opening of the contact set 30*a* permits an increase in resistance of the circuit for energizing the brake winding 18. Specifically, the winding energizing circuit includes that portion of the resistor 32 located between the tap on the latter connected to the contact set 28*a* and the end of the resistor connected to the winding 18 and which has a magnitude of resistance $R_2$ higher than the resistance $R_1$. Thus the braking current flowing through the winding 18 decreases to a magnitude of $I_2$ (see FIG. 2) while the corresponding braking force increases to a magnitude of $F_2$ (see FIG. 3).

When time point $T_3$ is reached, the timing relay 28 is picked up to open its contact set 28*a* resulting in the entire resistor 32 (whose resistance is of $R_o$) being serially connected to the brake winding 18. Thus a braking current $I_3$ less than the current $I_2$ flows through the winding 18 to increase a braking force to the magnitude of $F_3$ as shown in FIGS. 2 and 3.

On the other hand, the escalator is decelerated with the successively increased braking forces as above described until the contact set 24 is opened at time point $T_4$ (see FIGS. 2 and 3). Accordingly the relay 26 is deenergized to open the contact set 26a thereby to deenergize the brake winding 18 with the result that a rated braking force $F_o$ (see FIG. 3) due to the spring force alone is applied to the electric motor for the escalator to effect the perfect braking.

FIGS. 2 and 3 also show conventional braking process by broken lines. As shown by the broken line in FIG. 2, the braking current is suspended simultaneously with the deenergization of the electric motor for the escalator while at the same time an associated electromagnetic brake applies its rated braking force to the motor as shown by the broken line in FIG. 3. According to the present invention, however, the electromagnetic brake after having been deenergized once is again energized in response to a signal originating from that contact set sensing the dropout of the electromagnetic brake to be put into a partly released state in which the braking current flowing through the brake winding is stepwise decreased while the braking force is correspondingly increased in an incremental manner from a low magnitude to its maximum rated magnitude. In this way, the associated escalator is moderately decelerated until it is stopped.

As above described, the electromagnetic brake is again energized after the dropout thereof has been sensed. This is because it is extremely difficult to control electromagnetic brakes during their dropout and therefore it is necessary to control them upon reenergizing. However it is to be noted that no timer is used for the purpose of reenergizing the electromagnetic brake because the dropout of the brake can not be sensed by a timer.

It has been found that, by properly selecting the time delays intervals of the timing relays 28 and 30 and the magnitudes of the resistances $R_1$, $R_2$ and $R_3$ of the resistor 32, the arrangement of FIG. 1 can impart to the associated escalator a secure deceleration characteristic free from the fear that passengers on the escalator will fall down regardless of the length of the escalator. When the escalator decreases to a predetermined low speed or less, a signal resulting from a governor contact set suspends the control of the escalator to permit the braking with the maximum rated braking force resulting in the reliable stoppage of the escalator. In this case, no timer is also used because the timer can not sense the actual speed of the escalator and because there is, in many cases, a danger that objections such as the reserval of the travel will occur.

Figure 4:
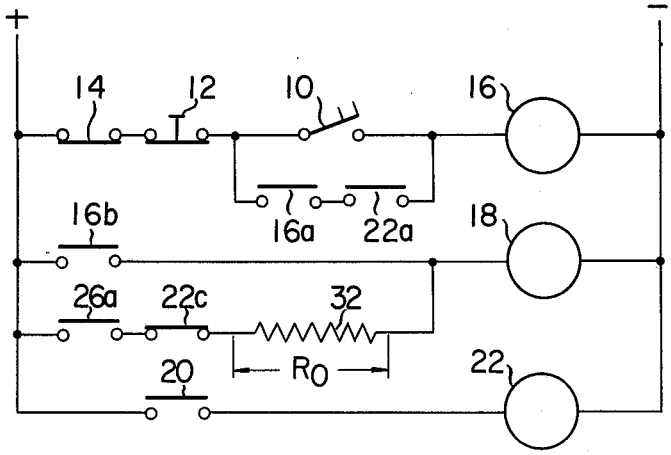
FIG. 4 is a diagram similar to FIG. 1 but illustrating a modification of the present invention.

In a modification of the present invention shown in FIG. 4 the resistor 32 connected to the brake winding 18 has a predetermined magnitude of resistance of $R_o$ but not the tapped resistance type and the timing relays and the associated components are omitted.

In other respects, the arrangement illustrated is substantially identical to that shown in FIG. 1 and like reference numerals have been employed to identify the components identical to or corresponding to those shown in FIG. 1.

The arrangement of FIG. 4 is substantially identical in operation to that shown in FIG. 1 except that in FIG. 4 the braking force applied to an associated electric motor changes from its low magnitude directly to its rated magnitude without the braking force having any intermediate magnitude therebetween. More specifically, after the stop has been instructed, that is to say, after the stop pushbutton 12 has been depressed, the brake winding 18 is again energized to permit a predetermined braking force less than the rated braking force to be applied to the associated electric motor to decelerate the escalator driven by the motor as in the arrangement of FIG. 1. Then the contact set 24 is opened in response to the escalator reaching a predetermined low speed. At that time the rated braking force is applied to the electric motor until it completely brakes to a stop the escalator.

It will be readily understood that, by properly selecting the resistance $R_o$ of the resistor 32, the proper deceleration characteristic can be obtained.

The arrangement of FIG. 4 is particularly advantageous in that it is formed by an extremely simple construction of a very small number of electric components alone and therefore is high in reliability.

Thus it is seen that the present invention provides a device for stopping a passenger conveyor in the normal manner by deenergizing the associated electric motor and then changing the current flowing through a brake winding involved thereby to successively increase the braking force from a small magnitude to its maximum rated magnitude to brake the electric motor. Therefore the passenger conveyor can be moderately decelerated and stopped. This measure prevents passengers on the passenger conveyor from violently falling down. Also the deceleration of the conveyor due to the low braking force developed at the beginning of the initiation of the deceleration arouses the passengers attention so that the passengers can be fully prepared for the stop. Thus the passengers can avert danger. In addition, the present invention is formed of only general electric components and is simple and economical in construction while it can readily be added to existing passenger conveyors.

While the present invention has been illustrated and described in conjunction with a few preferred embodiments thereof, it is to be understood that numerous changes and modifications may be resorted to without departing from the spirit and scope of the present invention. For example, the present invention is equally applicable to the DOWN travel of escalators and horizontally travelling passenger conveyors. Also while the resistor 32 is shown in FIG. 1 as including a pair of taps it is to be understood that it may include a single tap with either one of the timing relays 28 or 30 and the associated components omitted. Alternatively, the resistor 32 may include three or more taps while the number of timing relays is correspondingly increased with suitable contact sets operatively associated therewith.

What we claim is:

1. An electromagnetic braking means for a passenger conveyor having an electric motor driving means, said electromagnetic braking means comprising:

an electromechanical brake means having a spring means for normally applying a braking force to said passenger conveyor and an operating winding coupled to said spring means for opposing said spring means and reducing said braking force to a degree related to the current flowing therethrough;

a normal operation current source coupled to said electromechanical brake means for supplying said operating winding with a current to reduce said braking force to zero during the normal operation of the passenger conveyor;

a stop control means coupled to said electric motor driving means and said normal operation current source for deactivating said electric motor driving means and said normal current source when manually actuated;

a braking operation current source coupled to said electromechanical brake means for sensing the application of said braking force by said spring means and for supplying a predetermined current to said operating winding upon application of said braking force; and a stall speed sensor coupled to said braking operation current source for sensing the speed of said passenger conveyor and interrupting the current to said operating winding when the speed of said passenger conveyor is less than a predetermined speed, whereby said braking force is a maximum upon actuation of said stop control means, said braking force has a predetermined magnitude corresponding to said predetermined current during the operation of said braking operation current source and said braking operation current source and said braking force is a maximum when the speed of the passenger conveyor is less than said predetermined speed.

2. An electromagnetic braking means for a passenger conveyor as claimed in claim 1, wherein said braking operation current source comprises:

a voltage source;

a resistor connected is series with said operating winding having a predetermined resistance; and a switch means coupled to said electromechanical brake means responsive to the application of said braking force by said springs means for connecting said voltage source to said series connection of said resistor and said operating winding upon application of said braking force by said spring means.

3. An electromagnetic braking means for a passenger conveyor as claimed in claim 1, wherein said stall speed sensor comprises:

a governor means coupled to said electric motor driving means for sensoring the speed of said electric motor driving means; and a switch means coupled to said governor means and said braking operation current source for interrupting the current supplied to said operating winding by said braking operation current source when said governor detects a speed less than a predetermined speed.

4. An electromagnetic braking means for a passenger conveyor as claimed in claim 1, wherein said braking operation current source includes a stepwise current means for supplying a predetermined stepwise time decreasing current to said operating winding, whereby said braking force is stepwise time increasing.

5. An electromagnetic braking means for a passenger conveyor as claimed in claim 4, wherein said stepwise current means comprises:

a voltage source;

a plurality of resistors connected in series with each other and with said operating winding;

a switch means coupled to said electromechanical brake means responsive to the application of said braking force by said spring means for connecting said voltage source to said series connection of said plurality of resistors and said operating winding upon application of said braking force by said spring means; and a plurality of time delay switch means each responsive to said swtich means and each having a normally closed switch means connected in parallel to a corresponding one of said plurality of resistors, for opening said normally closed switch means a corresponding predetermined time after the operation of said switch means, whereby said predetermined current is stepwise time decreasing.

* * * * *